United States Patent [19]

Stadler et al.

[11] Patent Number: 5,065,663

[45] Date of Patent: Nov. 19, 1991

[54] ELECTROPNEUMATIC OR ELECTROHYDRAULIC LINEAR DRIVE MECHANISM

[75] Inventors: Heinz Stadler; Alfred Heinzl, both of Munich; Wilhelm Krakowetz, Buchloe, all of Fed. Rep. of Germany

[73] Assignee: Siemens Aktiengesellschaft, Munich, Fed. Rep. of Germany

[21] Appl. No.: 623,166

[22] Filed: Nov. 6, 1990

[30] Foreign Application Priority Data

Dec. 18, 1989 [DE] Fed. Rep. of Germany ..... 3941748

[51] Int. Cl.[5] ..... F15B 13/00

[52] U.S. Cl. ..... 91/361; 91/447; 91/459; 92/161; 92/165 R; 92/13.8

[58] Field of Search ..... 91/1, 459, 466, 467, 91/445, 447, 361; 92/161, 165 R, 13.5, 13.8, 166; 251/58; 417/45

[56] References Cited

U.S. PATENT DOCUMENTS

| | | | |
|---|---|---|---|
| 2,575,964 | 11/1951 | MacLean | 92/161 |
| 2,798,688 | 7/1957 | Affleck | 92/161 |
| 3,830,139 | 8/1974 | Wachsman et al. | 92/13.8 |
| 4,376,450 | 3/1983 | Fayfield et al. | 91/424 |
| 4,794,845 | 1/1989 | Vick | 91/467 |
| 4,987,822 | 1/1991 | Stoll | 91/DIG. 4 |

FOREIGN PATENT DOCUMENTS

| | | | |
|---|---|---|---|
| 0078496 | 5/1983 | European Pat. Off. | 92/13.5 |
| 0115008 | 8/1984 | European Pat. Off. | 91/1 |
| 0969985 | 10/1982 | U.S.S.R. | 92/165 R |

*Primary Examiner*—Edward K. Look
*Assistant Examiner*—Hoang Nguyen
*Attorney, Agent, or Firm*—Hill, Van Santen, Steadman & Simpson

[57] ABSTRACT

A linear drive mechanism has a combination of a drive cylinder, a drive rod stroke-limiting element, position sensors, a solenoid, and a terminal strip, together with internal wirings and hose connections. The drive mechanism can be arbitrarily arranged quickly and simply at a processing apparatus or assembly structure as a unit, and only a cable having the external signal and control lines as well as a supply line for the pressure agent need be connected thereto. No disturbing and involved wirings and position sensing elements therefore need be arranged in the actual tool region.

12 Claims, 2 Drawing Sheets

ELECTROPNEUMATIC OR ELECTROHYDRAULIC LINEAR DRIVE MECHANISM

BACKGROUND OF THE INVENTION

The invention is directed to an electropneumatic or electrohydraulic linear drive mechanism as employed, for example, in precision mechanical fabrication for processing and assembling individual parts.

For example, such drive mechanisms have become known wherein a drive cylinder is rigidly connected to a piston rod. Limit stops relative to a guide frame can also be provided at the piston rod. The control of the drive cylinder occurs via solenoids which, however, represent separate structural units. When such a linear drive is applied to a tool, the solenoid must be separately mounted and must be individually wired. Moreover, the hose connections from the solenoid to the drive cylinder must each be respectively individually produced. Due to the frequently great distance between solenoid and drive cylinder, long reaction times thus also result, this retarding the working clock. It is also necessary that a machine part or tool moved by the linear drive is sensed in its respective final positions. In traditional systems, this again occurs on the basis of sensor means that are additionally individually attached. These likewise have to be again individually wired with signal lines. Due to these many discrete parts having their own wirings and hose connections, it is not only complicated and difficult to plan and layout design of the tool arrangement that results, but the assembly itself becomes difficult and time-consuming. This has a disadvantageous effect, particularly given repair and refittings of such a fabrication system.

SUMMARY OF THE INVENTION

An object of the invention is to create a linear drive mechanism that permits a less complicated layout and overall design and a simplified assembly of the linear drive.

An electropneumatic or electrohydraulic linear drive mechanism of the invention has the following features:

- a drive cylinder that is connectable to a pressurized flow agent such that a piston seated in the cylinder is optionally displaced toward the one or other side, dependent on the respectively applied pressure;
- a drive rod connected to the piston;
- a guide element for the drive rod rigidly connected to the drive cylinder;
- lift-limiting elements that act between drive rod and guide elements;
- position sensors connected to the guide element;
- a valve means connected to the guide element that is connected to the drive cylinder via internal control hoses and is connectable to a flow agent supply via an external supply line; and
- signal and control lines for connection of the position sensors as well as of the valve means.

In the linear drive mechanism of the invention, the drive cylinder together with the drive rod is united not only with lift-limiting elements, but also with the position sensors, with the valve means, and with the corresponding lines to form a compact unit that can be easily and quickly mounted by itself. Since the valve means forms a part of this compact unit, the internal hose lines from the valve to the cylinder are extremely short, as a result whereof short reaction times of the motions and, thus, low clock times, can also be achieved. Since the position sensors are contained in the drive unit, they need not be provided in the tool design, so that this design becomes simpler to plan and lay out and simpler to assemble. The individual, internal machine wiring is thus also eliminated, as a result whereof assembly work is again eliminated and the time required for constructing the machine is shortened. The tools can be constructed separately from the drives. They are easy to couple and to interchange. On the basis of correspondingly long couplings or drive rods, the drives can be displaced from the tools to be driven to a suitable usually decentralized location outside of the tool. The planning and layout is thus improved and the maintenance of the machines is also facilitated.

In a preferable embodiment, the guide element has the shape of a bow that guides the guide rod in two guide legs. Stop elements, for example stop nuts that can be adjusted on a threaded section of the drive rod, are adjustably secured to the drive rod and preferably serve the purpose of limiting the stroke. These stop nuts can simultaneously be also employed for positional measurement when, for example, respective non-contacting proximity switches are provided in the guide legs which respond given the approach of a stop element. A carrier plate that carries the valve means, preferably solenoids, as well as a terminal strip for the signal and control lines, is preferably connected to the guide element. The electrical lines exiting to the outside can be combined to form a cable and can be coupled to a control means with the assistance of a multiple plug. A hose coupling preferably serves the purpose of connecting the flow agent.

DESCRIPTION OF THE PREFERRED EMBODIMENTS

Figure 1:
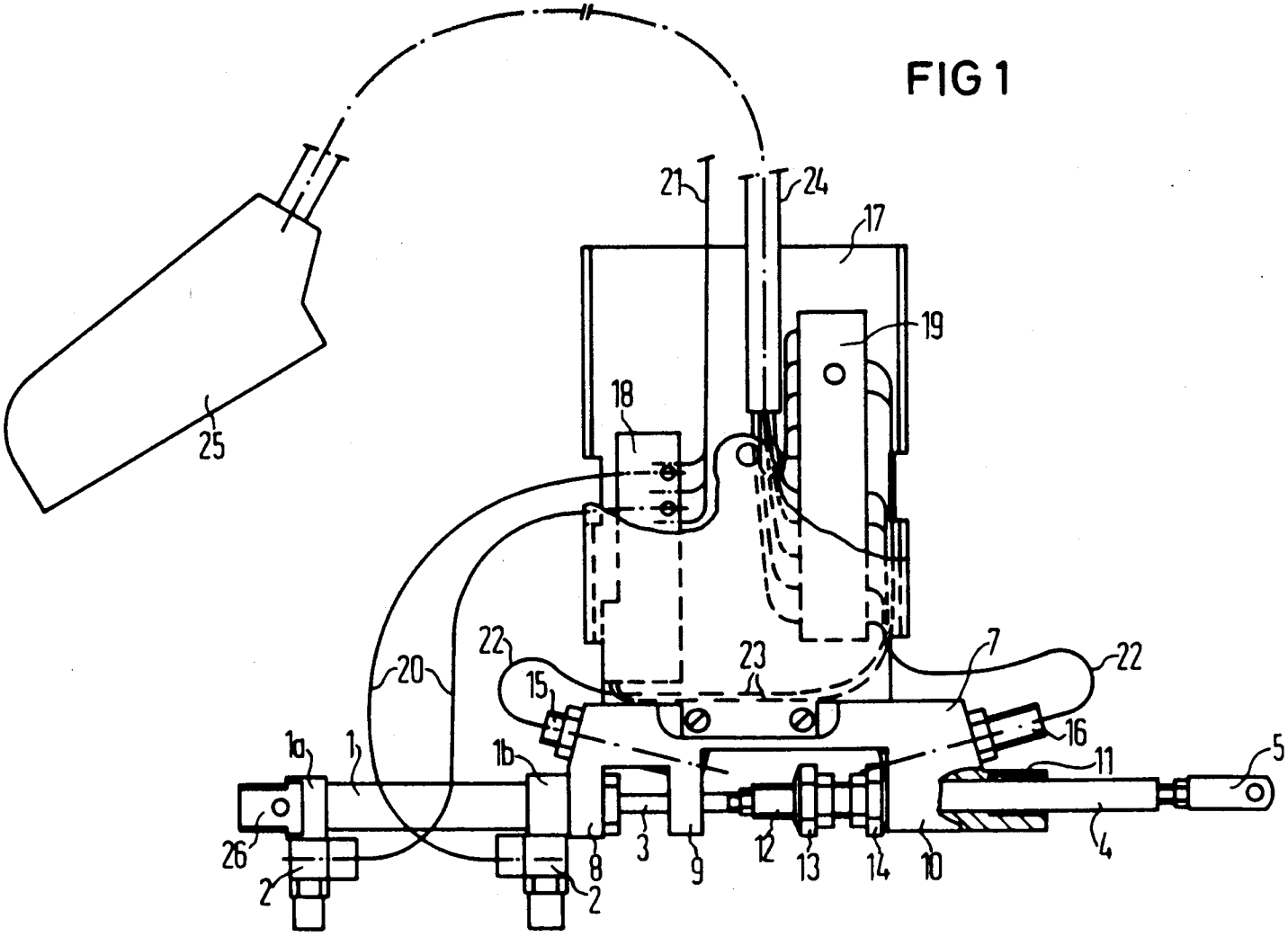
FIG. 1 is a schematic illustration of an electropneumatic linear drive mechanism designed according to the invention.

The linear drive mechanism shown in FIG. 1 has a compressed air cylinder 1 at whose ends 1a and 1b a respective compressed air input is provided via a throttle clack valve 2. The piston (not visible) moves a piston rod 3 that is connected to a coupling rod 4. The piston rod 3 and the coupling rod 4 are referred to in common here as a drive rod; this drive rod, for example, could also be formed of one part. The division into two parts, however, is advantageous since the coupling rod is thus easily interchangeable, and a coupling rod of greater or lesser length can thus be utilized for each application. Finally, the coupling rod can be coupled with a handle bar-shaped element 5 to a part to be actuated, for example a tool.

A bow-shaped guide element 7 has a fastening leg 8 rigidly connected to the cylinder 1 such that the drive rod 3 or 4 proceeds through the two guide legs 9 and 10, but lies free between them. At least the guide leg 10 forms a plain bearing in the form of a slide bushing 11 for the coupling rod 4. The coupling rod 4 comprises a threaded section 12 in the region between the two guide legs 9 and 10. Two stop nuts 13 and 14 are adjustably arranged on this threaded section 12. During the linear motion of the drive rod, the nuts 13 and 14 each strike the guide legs 9 or 10 and thus form a stroke limitation for the drive motion. Two non-contacting proximity switches 15 and 16 are also integrated in the guide element 7 such that they respectively detect the approach of a stop nut 13 or 14 to their limit position, i.e. they respond in the limit positions of the drive stroke.

A carrier plate 17 which carries a solenoid valve unit 18 and a terminal strip 19 is also secured to the guide element 7. The solenoid valve unit is connected to the clack valves 2 via short, internal hose lines 20. Externally, it is connectable to a compressed air supply via a supply line 21. This supply line, for example, is connectable to the solenoid via a rapid-action coupling (not shown). The terminal strip serves the purpose of coupling the signal lines 22 from the non-contacting switches 15 or 16 and the control lines 23 for the solenoid valve unit 18 to a cable 24 conducted toward the outside that can be quickly and simply connected to a control means with a multiple plug 25.

During operation, the cylinder has a shoulder 26 secured to a bearing. Dependent on the drive of the solenoid valve unit 18, the compressed air is admitted into the end 1*a* or into the end 1*b* of the cylinder, so that the coupling rod 4 moves toward the right or toward the left up to the respective detent. Reaching the limit position is identified via a non-contacting switch 15 or 16, and is reported via the signal lines. This signal can be interpreted in a control means, for example for switching the solenoid or for actuating another tool.

Figure 2:
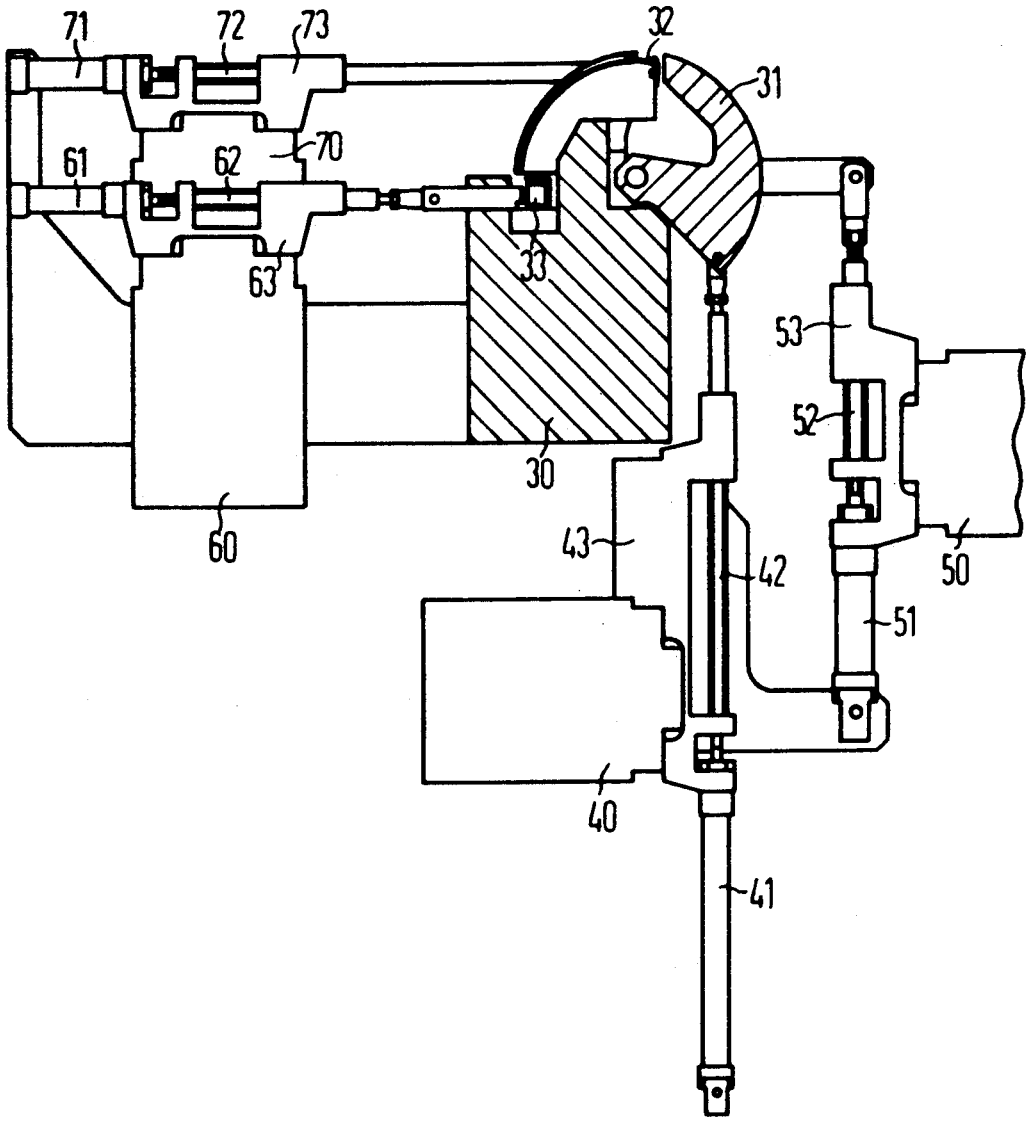
FIG. 2 is a schematic tool arrangement having a plurality of linear drive mechanisms.

FIG. 2 shows an example of the use possibilities of the linear drive mechanism of the invention. This shows a simplified, schematic section through a guide rail 30 on which, for example, an armature 32 is placed onto a magnet system 33 via a lever 31. Respective electro-pneumatic linear drive mechanisms can be employed for holding, deforming, and moving the various discrete parts. Four such drive mechanisms are shown by way of example in FIG. 2, namely the drive mechanisms 40, 50, 60 and 70. Each of these drive mechanisms comprises a drive cylinder 41, 51, 61 or 71, a drive rod 42, 52, 62 or 72, and a guide element 43, 53, 63 or 73. Dependent on the required stroke, cylinders, drive rods, and guide elements having different lengths can be employed. For example, the drive cylinder 41 and the guide element 43 are thus longer than the other cylinders and guide elements. The drive rod 72 of the drive mechanism 70, for example, is extremely long so that the drive mechanism 70 can be attached at a great distance from the assembly means itself. Although the details of the design of this assembly means and the function thereof shall not be shown in greater detail or explained in greater detail here, it can nonetheless be seen from FIG. 2 that the actual assembly means is extremely easy to plan and lay out, and is easily accessible as a result of the linear drive mechanisms employed here, since it is kept free of design parts, specifically the drives, wirings, compressed air hoses, and position sensors. All of these things are decentrally arranged in the individual drive mechanisms, so that the drive mechanisms only have their drive rod engaging into the actual assembly or processing region.

Although various minor changes and modifications might be proposed by those skilled in the art, it will be understood that we wish to include within the claims of the patent warranted hereon all such changes and modifications as reasonably come within our contribution to the art.

We claim as our invention:

1. An electromagnetic or electrohydraulic linear drive assembly, comprising:

a carrier member;

a guide element having first and second guide legs; first and second slidably mounted to the guide legs;

first and second stroke-limiting stop elements adjustably mounted to the drive rod such that they are positioned between the two guide legs and can strike against a respective guide leg depending on a direction of reciprocating movement of the drive rod;

a drive cylinder connected to the guide element and having a piston rod connected to one end of the drive rod, said drive cylinder having a first pressurized input at one end and a second pressurized input at the other end such that a piston connected to the piston rod seated in the cylinder is optionally displaceable toward one side or the other dependent on a pressure respectively applied at the respective first or second pressurized input;

a carrier member connecting to the guide element;

a solenoid valve means mounted on the carrier member, said solenoid valve means having a pressurized supply line input and first and second pressurized outputs connecting through respective pressure lines to the respective first and second pressurized inputs of the drive cylinder, said solenoid valve means controlling the reciprocating movement of the drive rod of the drive cylinder;

first and second position sensor means each formed of a non-contacting proximity switch mounted adjacent the respective guide elements for detecting an approach of the respective first or second stop element toward the respective first or second guide leg;

a connection cable having signal lines for the sensor means and control lines for the solenoid valve, the cable having one end mounted to the carrier member and the other end free and available for connection to a desired-control terminal; and the assembly forming a one piece unit which can be easily installed by mounting the assembly, connecting the free end of the cable to the control terminal, and connecting a pressure source to the solenoid valve means pressurized input.

2. An assembly according to claim 1 wherein the guide element has a bow shape.

3. An assembly according to claim 1 wherein the stroke-limiting stop elements each comprise a threaded section on the drive rod on which stop-dot means for limiting stroke are seated.

4. An assembly according to claim 1 wherein the signal lines and control lines of the cable connect to a terminal strip mounted on the carrier member.

5. An assembly according to claim 1 wherein the carrier member comprises a carrier plate.

6. An assembly according to claim 1 wherein the drive cylinder and the guide element are dimensioned according to the required stroke length for the drive rod.

7. An assembly according to claim 1 wherein a length of the drive rod is selected according to a required stroke length for the drive rod.

8. An assembly according to claim 1 wherein the guide element has a fastening leg spaced from one of the guide legs and to which one end of the drive cylinder is mounted such that the piston rod is in line with the drive rod of the assembly.

9. An assembly according to claim 1 wherein the two guide legs are spaced a sufficient distance to accommodate a required stroke length for the drive rod.

10. An assembly according to claim 1 wherein the piston rod and the drive rod comprise a one-piece rod which functions both as a piston rod connected to the piston of the drive cylinder and also as a coupling rod.

11. An assembly according to claim 1 wherein the free end of the connection cable terminates in a plug having a plurality of contact elements.

12. An assembly according to claim 1 wherein the drive cylinder has respective first and second clack valves at the respective first and second pressurized inputs.

* * * * *